US009328470B2

(12) United States Patent
Berto

(10) Patent No.: US 9,328,470 B2
(45) Date of Patent: May 3, 2016

(54) ILLUMINATED DISSUADER DEVICE

(71) Applicant: CAME Group S.p.A., Dosson di Casier (TV) (IT)

(72) Inventor: Renato Berto, Dosson di Casier (IT)

(73) Assignee: CAME GROUP SPA, Dosson di Casier (TV) (IT)

( * ) Notice: Subject to any disclaimer, the term of this patent is extended or adjusted under 35 U.S.C. 154(b) by 0 days.

(21) Appl. No.: 14/387,135

(22) PCT Filed: Mar. 19, 2013

(86) PCT No.: PCT/IB2013/052176
§ 371 (c)(1),
(2) Date: Sep. 22, 2014

(87) PCT Pub. No.: WO2013/140338
PCT Pub. Date: Sep. 26, 2013

(65) Prior Publication Data

US 2015/0050084 A1 Feb. 19, 2015

(30) Foreign Application Priority Data

Mar. 20, 2012 (IT) ..... TO2012A0250

(51) Int. Cl.
*E01F 13/04* (2006.01)
*E01F 15/00* (2006.01)
*F21V 33/00* (2006.01)
*F21W 111/02* (2006.01)

(52) U.S. Cl.
CPC ..... *E01F 13/044* (2013.01); *E01F 13/046* (2013.01); *E01F 15/00* (2013.01); *F21V 33/0076* (2013.01); *F21W 2111/02* (2013.01)

(58) Field of Classification Search
CPC ..... E01F 9/0175; E01F 9/019; E01F 13/026; E01F 13/048; E01F 13/123; E01F 13/046; E01F 13/04; E01F 13/044; E01F 15/00
USPC ..... 404/6
See application file for complete search history.

(56) References Cited

U.S. PATENT DOCUMENTS 4,919,563 A * 4/1990 Stice ..... E01F 13/046 404/6
5,070,646 A * 12/1991 Colombo ..... E01F 13/046 404/6

(Continued)

FOREIGN PATENT DOCUMENTS

DE 197 14 207 10/1998
EP 0 627 527 12/1994

(Continued)

OTHER PUBLICATIONS

International Search Report for International Application No. PCT/IB2013/052176 mailed Sep. 11, 2013 (3 pages).

*Primary Examiner* — Abigail A Risic
(74) *Attorney, Agent, or Firm* — Merchant & Gould P.C.

(57) ABSTRACT

An illuminated dissuader device includes a frame (1) to be secured to the ground and a bollard (10) that comes out from the ground to form an obstacle protruding therefrom. The bollard (10) includes a base (12) connected to the frame and an upper portion (11) having a tubular lighting element (111) extending substantially along the entire length of the upper portion.

7 Claims, 4 Drawing Sheets

(56) References Cited

U.S. PATENT DOCUMENTS

| | | | | |
|---|---|---|---|---|
| 5,425,595 | A * | 6/1995 | Roper | E01F 13/046 404/9 |
| 5,476,338 | A | 12/1995 | Alberts | |
| 6,626,606 | B1 * | 9/2003 | Johnson | E01F 9/0175 404/10 |
| 2004/0175231 | A1 * | 9/2004 | Reale | E01F 13/04 404/6 |
| 2007/0031189 | A1 * | 2/2007 | Stadler | E01F 13/046 404/6 |
| 2008/0290333 | A1 | 11/2008 | Parenti et al. | |
| 2013/0094902 | A1 * | 4/2013 | Chang | E01F 13/046 404/6 |
| 2014/0147201 | A1 * | 5/2014 | Ball | E01F 13/046 404/6 |
| 2014/0328621 | A1 * | 11/2014 | Broadhurst | E01F 13/046 404/6 |

FOREIGN PATENT DOCUMENTS

| | | |
|---|---|---|
| EP | 2 267 226 | 12/2010 |
| WO | WO 98/42534 | 10/1998 |

* cited by examiner

ILLUMINATED DISSUADER DEVICE

This application is a National Stage Application of PCT/IB2013/052176, filed 19 Mar. 2013, which claims benefit of Serial No. TO2012A000250, filed 20 Mar. 2012 in Italy and which applications are incorporated herein by reference. To the extent appropriate, a claim of priority is made to each of the above disclosed applications.

BACKGROUND

The present invention relates to the field of street furniture, in particular to devices commonly referred to as dissuaders, which are adapted to prevent or control the access to areas subject to traffic limitations, such as pedestrian precincts or restricted traffic zones (RTZ), etc., or to protect particular buildings or sites against unwanted intrusion.

Devices of this kind are also known which selectively deny access to a vehicle (bicycle, motorcycle, car, . . . ) to restricted traffic zones, such as pedestrian precincts, private parking areas, private parks, residential buildings, etc.

Such devices are generally equipped with an automatic control system that allows them to switch from a state in which they are retracted in the ground to a state in which they are extended upwards to form a barrier that obstructs access to the controlled area.

They are often installed on road surfaces, and disappear into the ground when access is allowed.

Such devices are usually made up of a frame with its top face flush with the ground, in which a cylindrical body is slideably mounted between a position retracted in the ground and a protruded position. Said frame comprises means for moving said cylindrical body between the two above-mentioned positions, such as, for example, screw jacks, hydraulic or pneumatic cylinders, etc.

The cylindrical body or bollard is sometimes fitted with a reflective band or LED's for being visible at night.

Such bollards may also be fitted with audio equipment, for being signalled to blind people, and may be customized with the owner's name or logo.

For upkeeping these bollards and for modifying their accessories, it is generally necessary to disassemble most of the device to gain access to the inside thereof, which is a costly and time-consuming task.

Devices are also known which stay fixed in the extended position, thus providing permanent access restrictions.

SUMMARY

It is the object of the present invention to provide an illuminated dissuader device, i.e. a dissuader device equipped with means for illuminating a significant portion of the exposed part thereof.

One aspect of the present invention relates to an illuminated dissuader device.

BRIEF DESCRIPTION OF THE DRAWINGS

Other features and advantages of the invention will now be described with reference to an embodiment thereof as shown in the annexed drawings, wherein.

DETAILED DESCRIPTION

Figure 1:
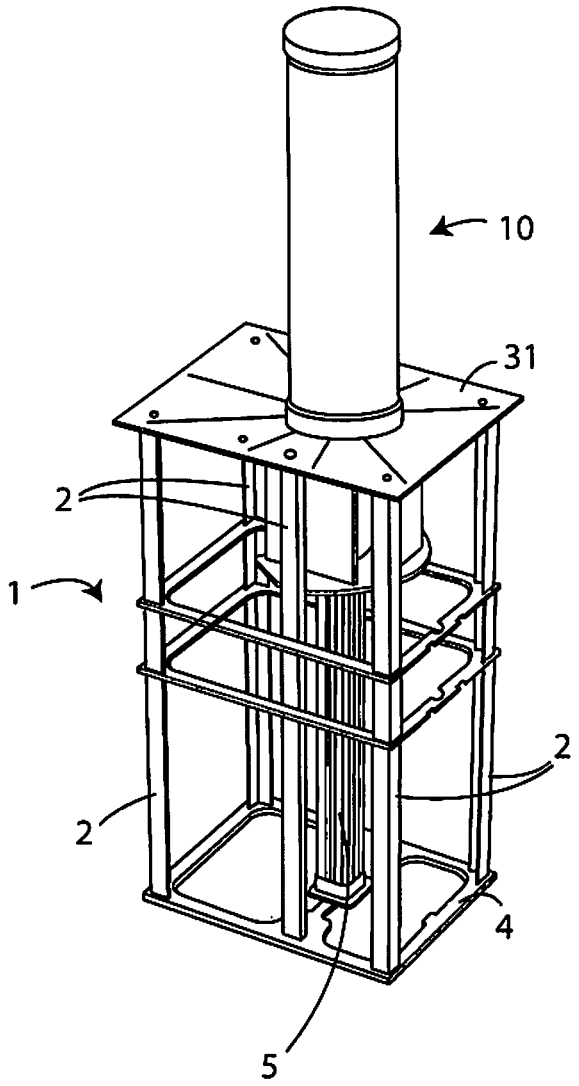
FIG. 1 is a perspective view of the illuminated dissuader device according to the invention, wherein the bollard or cylindrical element is in an extended position.
Figure 2:
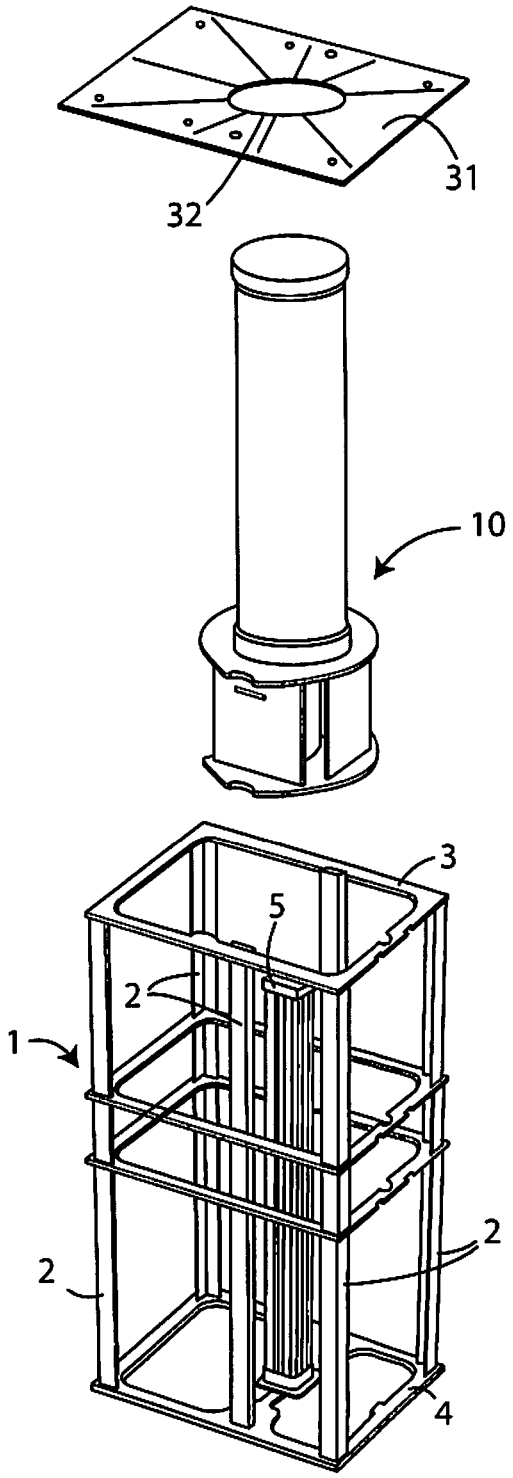
FIG. 2 is an exploded perspective view of the device of FIG. 1.
Figures 3, 4:
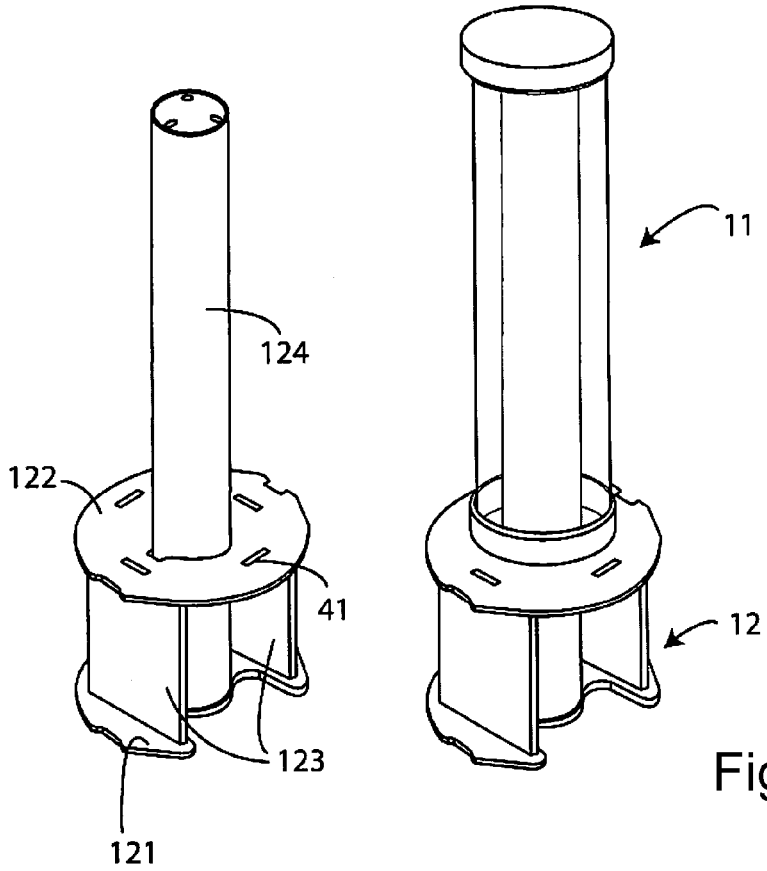
FIG. 3 is a perspective view of the bollard of the dissuader of FIG. 1.
FIG. 4 is a perspective view of the base portion of the bollard of FIG. 3.
Figures 5, 6, 7:
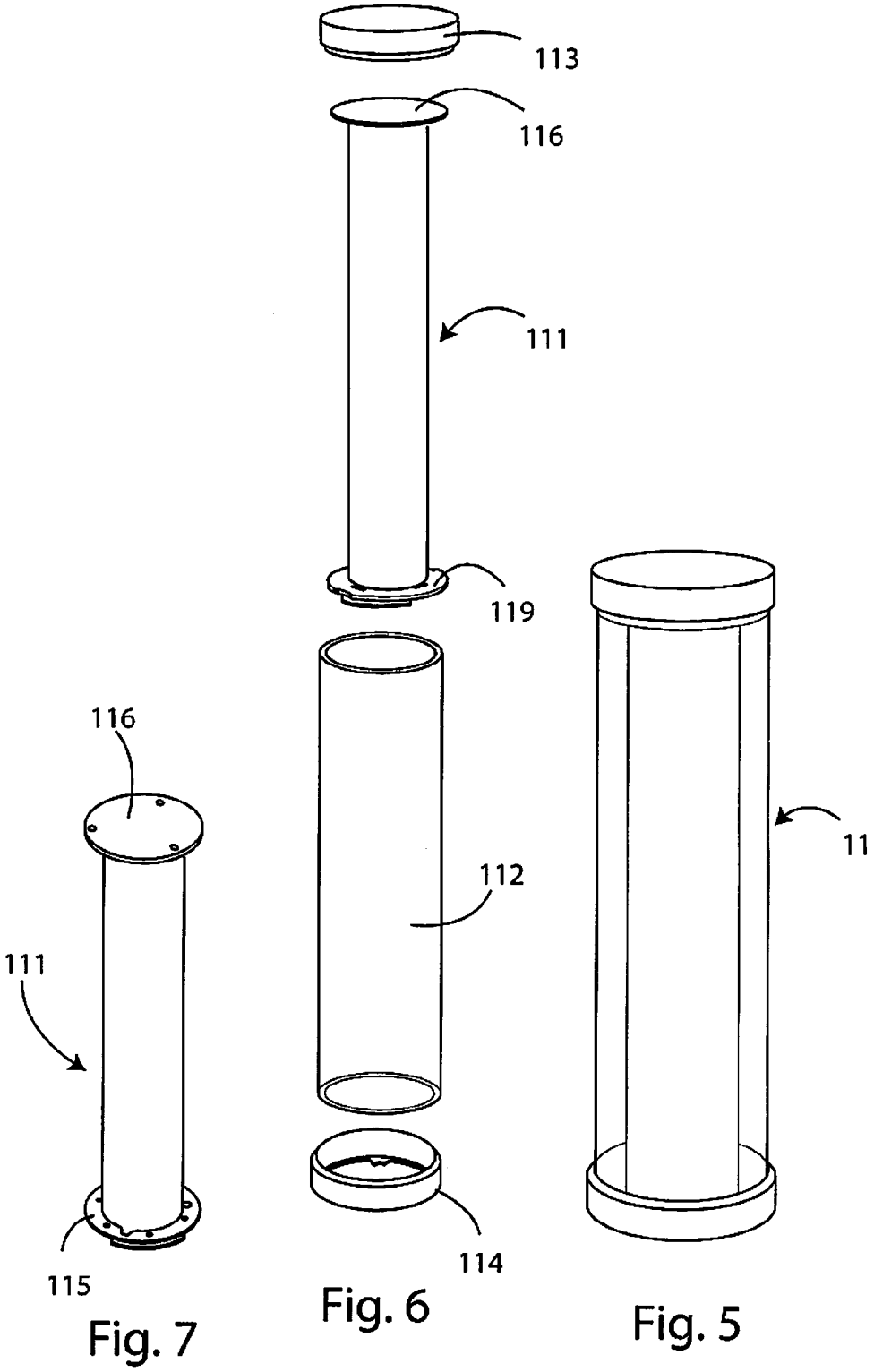
FIG. 5 is a perspective view of the upper portion of the bollard.
FIG. 6 is an exploded perspective view of the upper portion of the bollard.
FIG. 7 is an exploded perspective view of the tubular lighting element according to the present invention.

With reference to the above-mentioned drawings, the dissuader device of the invention comprises a substantially rectangular frame 1, which is driven into the ground or, in general, into a horizontal plane, e.g. a road surface. Frame 1 preferably comprises a plurality of vertical metal rods 2, which connect a substantially rectangular upper bracket 3 to a lower bracket 4 having the same shape. The metal rods are also connected to the corners of brackets 3 and 4, and define a seat within frame 1.

The upper bracket is flush with the plane, and supports a plate 31 with an aperture 32 at its centre. Bollard 10, preferably cylindrical in shape, is slideably mounted vertically in frame 1 between a retracted position, in which its top end is flush with the plane and with plate 31 through said aperture 32, and a protruding or extended position, in which the bollard goes past the plate to form an obstacle.

Actuating means 5, e.g. electric or hydraulic actuators or actuators of any kind, are arranged inside the frame and are associated with said bollard to allow it to move vertically.

In this embodiment, bollard 10 comprises a preferably cylindrical upper portion 11 and a circular base portion 12.

Said base comprises a lower disc 121 and an upper disc 122, joined together by at least two substantially rectangular walls 123 and a tubular bar 124, which engages into an aperture of the upper disc 122 and extends preferably along the entire length of bollard 10. Upper portion 11 comprises a tubular lighting element 111, a transparent covering 112 to be fitted onto said lighting element, and respective lower and upper plugs 113 and 114.

The tubular lighting element extends substantially along the entire length of upper portion 11. Furthermore, said lighting element, which is comparable, for example, to a neon light, may comprise a LED light source and an element for diffusing light throughout the upper portion of the bollard. In this way, substantially all the visible part of the dissuader device is lit when the device is in the extended or protruding position, thus forming a well-visible barrier, or clearly delimiting a path when multiple devices are arranged at the sides of said path.

According to the present invention, said lighting element 11 is fitted onto said bar 124 and is constrained to the bollard base through rotary fitting means. Such means comprise a suitable seat 41 obtained on the bollard base, in particular on upper disc 122, into which a fitting element provided on a ring 115 integral with the base of lighting element 111 is inserted. In this manner, the lighting element can be inserted into the base of the bollard and constrained to the latter by rotating the element until it is locked by the fitting means. Should removal of the lighting element be necessary, e.g. for replacement or maintenance, the constraint between the lighting element and the bollard base can be unlocked by inserting suitable unlocking means (e.g. a special wrench, a screwdriver or a punch)

into said seat. Once unlocked, the tubular lighting element can be rotated to a position where it can be extracted from the bollard base.

At the top of the lighting element there is a closure plate 116 that also secures the transparent covering fitted onto the lighting element.

The invention claimed is:

1. Illuminated dissuader device comprising a frame configured to be secured to the ground and a bollard that comes out from the ground to form an obstacle protruding therefrom, the bollard comprises a base connected to the frame and an upper portion comprising a tubular lighting element extending substantially along an entire length of the upper portion;

wherein:

said base comprises a lower disc and an upper disc joined together by at least two substantially rectangular walls, and a vertical tubular bar onto which said lighting element is fitted, the tubular bar engaging an aperture of the upper disc and extending along the entire bollard;

said lighting element is constrained to the base of the bollard through rotary means for fitting;

said fitting means comprise a seat on the base of the bollard for inserting a fitting element present on a ring integral with the base of the lighting element.

2. The dissuader device according to claim 1, wherein said bollard is movable between a retracted position, wherein a top end is flush with the ground, and a protruding or extended position, wherein said bollard forms an obstacle protruding from the ground.

3. The dissuader device according to claim 1, wherein said lighting element comprises a set of LED arrays.

4. The dissuader device according to claim 1, wherein said tubular lighting element is a LED light source associated with an element for diffusing light throughout the upper portion of the bollard.

5. The dissuader device according to claim 1, wherein a transparent covering is fitted onto said lighting element.

6. The dissuader device according to claim 1, wherein said seat is on said upper disc.

7. The dissuader device according to claim 1, wherein said lighting element is configured as a neon light.

* * * * *